United States Patent [19]

Minnetti

[11] 4,349,309

[45] Sep. 14, 1982

[54] DEVICE FOR THE TRANSFER OF YARN HANKS

[75] Inventor: Federico Minnetti, Pieve a Nievole, Italy

[73] Assignee: Officine Minnetti di Ornella Raveggi & C.S.a.s., Pieve a Nievole, Italy

[21] Appl. No.: 129,881

[22] Filed: Mar. 13, 1980

[30] Foreign Application Priority Data

Sep. 28, 1979 [IT] Italy ..... 26128 A/79

[51] Int. Cl.[3] ..... B65H 54/56

[52] U.S. Cl. ..... 414/744 A; 414/751; 242/110.1; 198/488

[58] Field of Search ..... 68/188; 414/728, 744 R, 414/744 A, 744 B, 744 C, 749–751, 753; 198/471, 489, 488, 490; 242/53, 110.1

[56] References Cited

U.S. PATENT DOCUMENTS

| | | | |
|---|---|---|---|
| 3,412,872 | 11/1968 | Cookson | 414/744 A |
| 3,731,822 | 5/1973 | Friesen | 414/744 X |
| 3,760,956 | 9/1973 | Burch | 414/744 A |
| 3,825,196 | 7/1974 | Yamazaki . | |
| 3,888,361 | 6/1975 | Becker et al. | 414/751 X |
| 4,187,051 | 2/1980 | Kirsch et al. | 414/744 R |

FOREIGN PATENT DOCUMENTS

| | | |
|---|---|---|
| 1480045 | 5/1967 | France . |
| 270221 | 8/1950 | Switzerland . |

*Primary Examiner*—Trygve M. Blix
*Assistant Examiner*—Terrance L. Siemens
*Attorney, Agent, or Firm*—Fleit & Jacobson

[57] ABSTRACT

A rotating device for rotatably transferring yarn skeins or hanks from a first generally stationary support or carrier to a second generally movable support or carrier, the latter being substantially at the same level as the first support or carrier, comprises a vertical structure, carrying two slide guides parallel to the movement of the second support; thereon a carriage having a rotating head is movable and has a rotating frame with two slide bars integral therewith; a rod carrying slider moves forwardly and backwardly on the bars, and carries two skein-holder rods which are parallel to each other and can be moved toward and away from each other. Preferably, the rotational movement is given by a cylinder-piston assembly between the vertical structure and an eccentric location on the rotating frame.

5 Claims, 4 Drawing Figures

DEVICE FOR THE TRANSFER OF YARN HANKS

The invention relates to a device for the transfer of yarn skeins or hanks from a first support to a second support, one of which may be movable. In systems or plants for the processing of yarns in hanks, a problem resides in the handling of hanks for transfer from one to another location of the system or from one to another conveyor. Generally, such a handling is manually carried out, and has the disadvantage of involving some labour, which is expensive; and also involves to some extent a yarn snarling, thereby subsequently causing a larger period of time required for hanks unwinding or reeling off.

The object was proposed of mechanizing the operation of hank transfer.

This has been accomplished by the device according to this invention, which device comprises a fixed frame work or structure, on which a carriage carrying rotatable head can slide parallel to the path of the moving support or carrier, said head carrying a rotating frame which supports a pair of spreadable skein-holder rods, movable between advanced and retracted positions relative to the frame.

A device according to the present invention is particularly adapted for transferring skeins or hanks from a first carrier to another carrier, when the two carriers are at the same level, or when one of said carriers is adjustable in height; when only one of the two carriers is moving; and when the two carriers are positioned at an angle therebetween which is less than 120°, preferably about 90°.

The novel device enables a rapid and accurate transfer of yarn skeins, without any use of labour and without yarn snarling; in use such device is mechanically simple, functional and of comparatively low cost.

A more detailed description of the subject invention will be given in the following with reference to an exemplary and unrestrictive illustrative embodiment, as shown on the accompanying drawings, in which.

Figure 1:
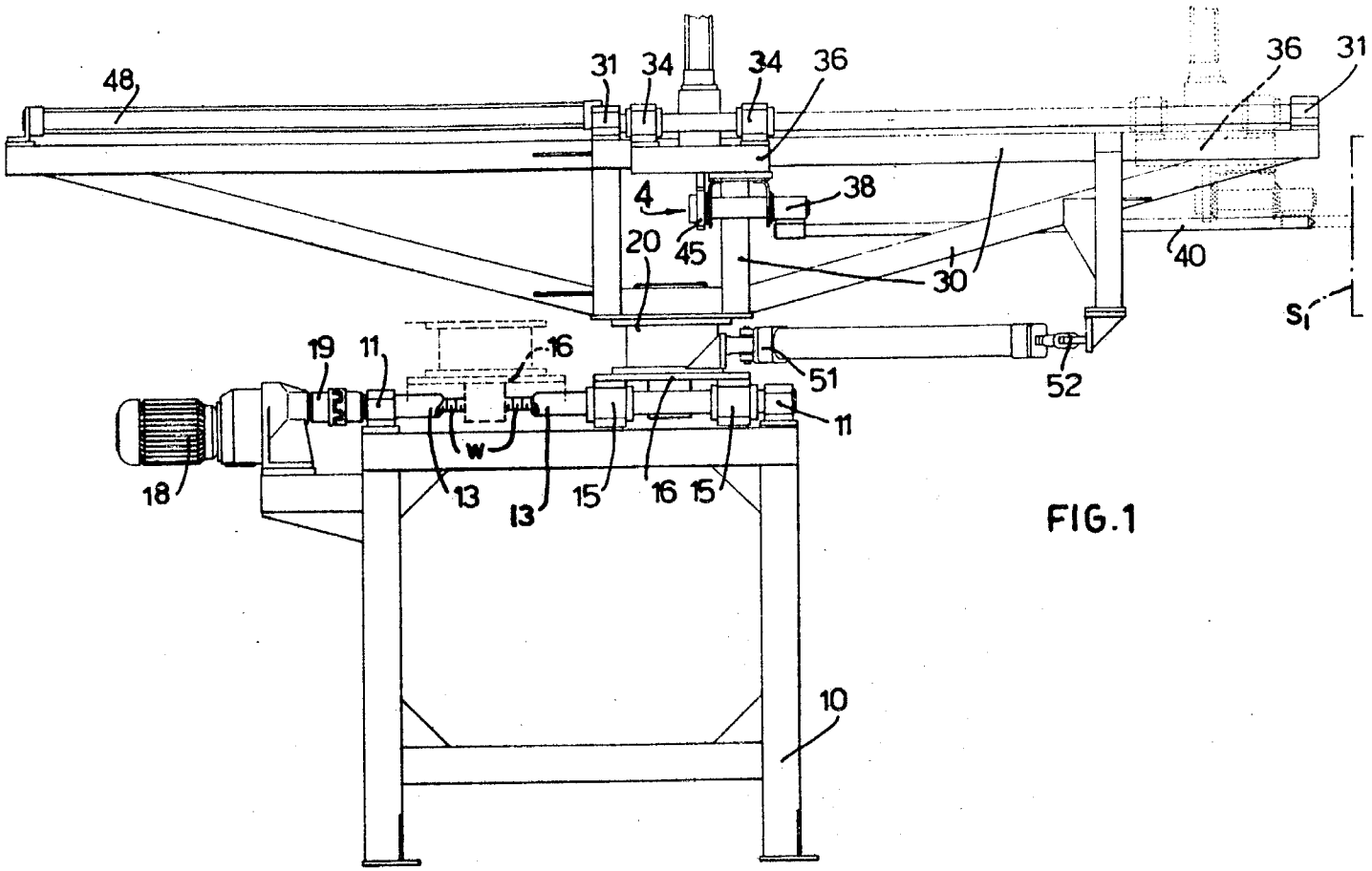
FIG. 1 is a side elevational view of the device with some parts which have been removed for showing the underlying parts.

A rotating type of device according to the invention comprises a vertical frame work or structure designated as a whole at 10. Said structure 10 has fastening brackets 11 thereon, carrying slide guides 12 and 13, which are parallel to one another and to the movement path of a hank-carrier or support. A carriage 16 is slidably mounted on said guides 12 and 13 by four sliding bearings 15. The translational movement of said carriage 16 in both directions along said guides 12 and 13 is controlled from a motor variator reducer 18 through a clutch 19 and through a worm screw W, a portion of which is illustrated in FIG. 1, as well known to those skilled in the art. Of course, any other moving system known to the those skilled in the art could be applied as well.

Figure 3:
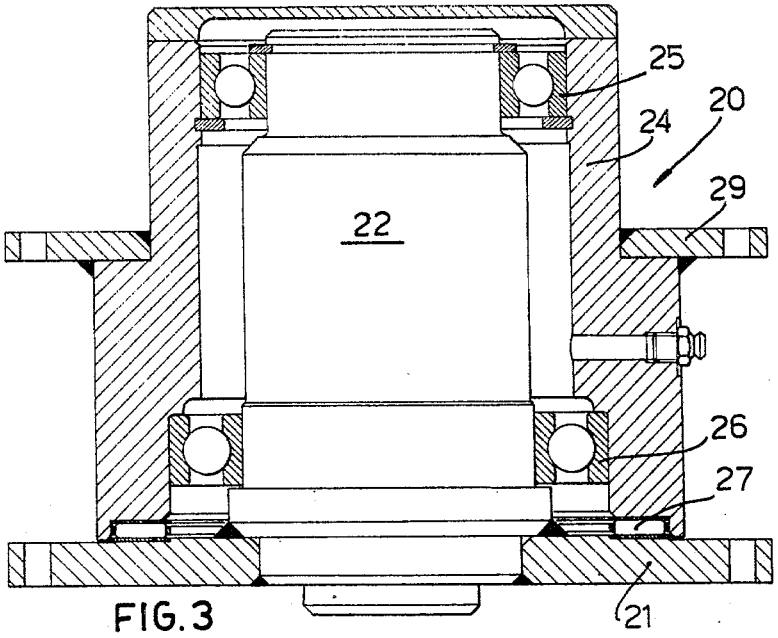
FIG. 3 is a vertical sectional view of an unrestrictive example of rotating head.

Said carriage 16 carries a rotating head, designated as a whole at 20; although the latter may be implemented in various equivalent ways well known to those skilled in the art, a presently preferred embodiment thereof is shown in FIG. 3. A plate 21 integral with said carriage 16 has a pin 22 secured thereto, having mounted thereon a bell-like element 24 through bearings 25 and 26 and a thrust bearing 27. A projecting plate 29 is welded to said bell-like element 24.

Figure 4:
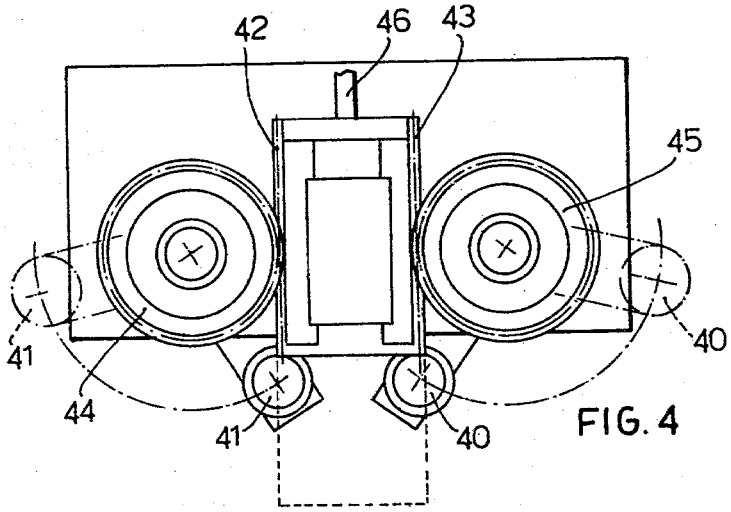
FIG. 4 is a schematic view, substantially taken from 4 of FIG. 1, showing a rod-spreading mechanism for the transfer of skeins or hanks between the two supports, one of which is moving.

On the rotating portion of said rotating head 20, for example on plate 29, there is mounted a rotating frame, designated as a whole at 30, which frame may be of any suitable configuration, but essentially comprises on mountings 31 two parallel sliding bars 32 and 33. The rotation for frame 30 is provided by any means within the range of those skilled in the art, preferably by a cylinder-piston assembly 50, at one end 51 pivoted on said carriage 16 and at the other end 52 pivoted at an eccentric location on frame 30. A rod carrying slider 36 is slidably mounted on said bars 32 and 33 by supports 34, and carries two rotatable rod carrying pins 38 and 39, each of which eccentrically carries a respective skein-holder rod 40 and 41. Such skein-holder rods are movable integrally with said slider 36 and can be moved between a closed position shown in FIGS. 1 and 2 and by full line in FIG. 4, and a spreaded or spaced apart position shown by dashed line in FIG. 4. The spreading movement for the rods is preferably provided by racks 42 and 43, controlled by a piston rod 46 and gear wheels 44 and 45 meshing with such racks. The forward movement of rod carrying slider 36 is controlled by a cylinder-piston assembly 48.

The operation of the rotating device will now be briefly described.

Figure 2:
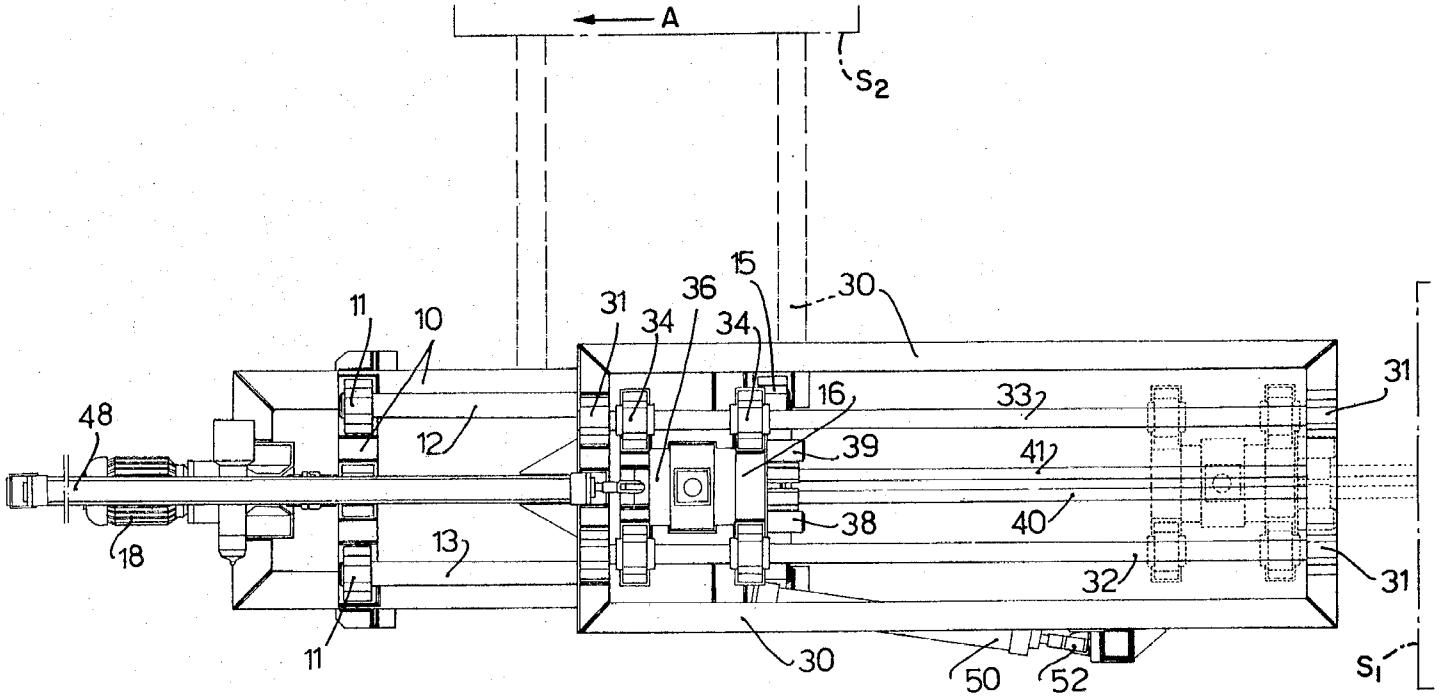
FIG. 2 is a plan view of the device.

Under its condition shown by full line in FIGS. 1 and 2, that is with the carriage to the right on bars 12 and 13 on the figures of the drawing, the slider 36 will move with said rods 40 and 41 closed, i.e., close to each other, to the position shown by dashed line in said figures of the drawing. The carrier or support $S_1$ holding the hanks or skeins, or rather the upper side of the skeins, that have to be withdrawn, should accordingly be slightly above the level of the rods when in their closed position, so that the latter can be inserted in the skein. Thus, a movement is caused for the racks 42 and 43 in order to spread apart the rods, from the position shown by full line to that shown by dashed line, as it appears from FIG. 4, so that the rods, becoming spaced apart and raising over the hank-carrier will take the hank thereon. Then, the cylinder-piston assembly 48 pulls the slider back with the rods spreaded apart and the hank thereon to release or clear the support $S_1$; then the cylinder-piston assembly 50 is operated, to cause said frame 30 and relating elements to effect the predetermined rotation (for example, through 90° to pass from full line to dashed line positions, as shown in FIG. 2).

Now, said cylinder-piston assembly 48 causes a further forward movement of slider 36 and rods 40 and 41 in order to lay the hank down onto the second carrier or support $S_2$, while, should the latter be moving as illustrated by arrow A, the motor variator 18 will cause a movement parallel to and at the same speed of said carriage 16 along said bars 12 and 13 to the positions shown by dashed line in FIG. 1. Then, said rods 40 and 41 would close to lay the hank down onto the second support and would then be moved back or retracted. After hank unloading, said motor provides for moving said carriage 16 back to starting position.

It should be noted that the described angle of 90° may be varied within determined limits depending on the location and arrangement of the first hank-carrier and the path of travel of the second hank-carrier.

Also the operation for the rods may be varied, which rods may be of the hank gripping type by externally "pinching" thereof, as described in other applications of the same applicant.

All of the changes and modifications within the range of those skilled in the art are to be intended as within the scope of the present invention.

What is claimed is:

1. A device for transferring yarn hanks from a first support or carrier to a second support or carrier, one of said first and second supports being a moving support, said device comprising: a vertical structure (10) having slide guides (12, 13) integral therewith and extending parallel to the direction of movement of said one support; a carriage (16) movable on said guides; means for moving said carriage; a rotatable head (20) carried by said carriage; means for rotating said head; a frame (30) integral with said rotating head; slide bars (32, 33) carried by said rotatable head; a slider (36) movable on said slide bars; means for moving said slider; spreadable skein-holder rods (40, 41) carried by said slider; and means for moving said rods between a closed position in which the rods are parallel and closely spaced from each other and a spaced apart position; said rods in the closed position being insertable into a yarn hank to be transferred from the first support and being moved to the spaced apart position to thereby transfer the yarn hank to said rods, movement of said slider and said rotatable head moving said rods into a position for transferring the yarn hank to the second support.

2. A device according to claim 1, characterized in that said means for rotating said head comprises a cylinder-piston assembly (50), which at one end (51) is pivoted to said carriage (16) and at the other end (52) is pivoted at an eccentric location of said frame.

3. A device according to claim 1, characterized in that the movement to said carriage (16) is given through a worm screw assembly (W) by a motorvariator reducer (18).

4. A device according to claim 1, characterized in that said means for moving said slider (36) comprises a cylinder-piston assembly (48).

5. A device according to claim 1, characterized in that said rotating head (20) comprises a bell-like element (24) which is rotatably mounted by bearings on a pin (22) secured to said carriage (16).

* * * * *